US005560045A

United States Patent [19]

Rockefeller

[11] Patent Number: 5,560,045

[45] Date of Patent: Oct. 1, 1996

[54] MULTI-PURPOSE APPARATUS BRACES/SUSPENDERS AND METHODS OF THEIR USE

[76] Inventor: Tara S. Rockefeller, 34 Gramercy Park East, New York, N.Y. 10003

[21] Appl. No.: 204,946

[22] Filed: Mar. 2, 1994

[51] Int. Cl.[6] ..... A41F 3/02

[52] U.S. Cl. ..... 2/327; 24/265 EC; 2/340

[58] Field of Search ..... 2/327, 323, 326, 2/329, 336, 340, 338; 24/342, 265 EC, 265 AC

[56] References Cited

U.S. PATENT DOCUMENTS

| | | | |
|---|---|---|---|
| 577,757 | 2/1897 | Kern | 2/327 |
| 1,100,581 | 6/1914 | Kornreich | 2/326 |
| 1,352,903 | 9/1920 | McConnell | 2/327 |
| 5,172,429 | 12/1992 | Lucier | 2/327 |
| 5,353,479 | 10/1994 | Lucier | 2/327 |

*Primary Examiner*—C. D. Crowder
*Assistant Examiner*—Gloria Hale
*Attorney, Agent, or Firm*—Fulbright & Jaworski L.L.P.

[57] ABSTRACT

An attachment device and method of operation is described for securing an article of clothing, such as a pair of suspenders, to a pair of pants or a skirt. The attachment device is connected to the suspenders by a loop of flexible material. An embodiment of the attachment device uses a gripping mechanism having a rotatable flap that is adapted to pass through an opening in the flexible loop. The opening in the loop is alternatively used for attachment to a button affixed to the article of clothing.

12 Claims, 3 Drawing Sheets

MULTI-PURPOSE APPARATUS BRACES/SUSPENDERS AND METHODS OF THEIR USE

TECHNICAL FIELD OF THE INVENTION

This invention relates in general to suspenders and braces, their attachment apparatus and methods of their use. This invention is particularly related to a multi-purpose attachment apparatus that attaches to an article of clothing whether or not the clothing has been modified with buttons for gripping the brace ends.

BACKGROUND OF THE INVENTION

A person's style of dress and personal appearance has a direct effect on that person's self-esteem, social and professional status. Belts and suspenders have been practical clothing accessories used for many years by a number of cultures by men, women and children. Although these accessories perform a desired function, they have also provided a means of adding variety and creativity to an individual's appearance. Today there is a large competitive international market for functional and decorative clothing accessories.

Currently there are two methods for attaching suspenders to articles of clothing. The first method uses a clip adapted to grip the top edge of the article of clothing. The second method (called a brace) uses a Y-shaped extension which has a button hole on each prong of the bifurcated end. The buttonholes allow the braces to be attached to buttons that are specifically added to clothing apparel for that purpose.

One problem with the currently available methods for attaching braces is that a person must buy specially adapted clothing with extra buttons. There is another alternative and that is to sew buttons onto clothing which has no buttons but this is cumbersome. The buttons have to be evenly spaced and aligned properly in order to wear a button brace properly.

The alternative is to use suspenders that have an unattractive, unprofessional looking clip for attaching the suspenders to the clothing. There is a system which has been on the market which combines both a button end of a suspender with a clip end. In that system the ends of the suspender have the traditional end loop or "ears" each ending in a button hole for connection to buttons sewn onto the pants. Hanging from the center of the "ears" is a short length of suspender material ending in a traditional clip. This is unsightly and very unprofessional looking. Men and women take pride in their appearance and do not like to be limited in their expression of personal style.

Accordingly, a need exists for an economical, convenient means of attaching suspenders to an article of clothing that can provide an unlimited variety of attractive, sophisticated styles to choose from and that is not limited for use with specially adapted clothing.

A further need exists in the art for a pair of braces that yields a professional appearance whether or not they are used with buttons pre-sewed into articles of clothing.

Another object of the present invention is to provide an attractive, sophisticated visible surface area at the location where suspenders are attached to the clothing apparel.

Yet another object of the present invention is to provide an economical, convenient means for attaching suspenders/braces to clothing apparel that will allow an individual to customize his/her suspenders/braces to match the clothing in both color and style.

Another object of the present invention is to provide both suspenders and braces that allows for use on both dress and casual clothing and which can be switched easily from one to the other.

SUMMARY OF THE INVENTION

The present invention fulfills the need discussed above by establishing a stylish, yet economical means of securing suspenders to pants or skirts whether or not the article of clothing has buttons positioned thereon.

Broadly, one embodiment of the present invention is an apparatus for attaching a pair of suspenders to a piece of clothing. The apparatus has a gripping mechanism, including inner and outer jaws and a lever for operating the jaws. Connecting the jaws to the suspenders is a strap of flexible material which is looped to form a front flap which covers the jaws when the jaws are gripping a piece of clothing. In addition, the front flap includes an opening slot adapted to slip over a button fastened on the clothing. The slot also functions to allow the jaw opening/closing lever such that whenever the lever is passed through the opening it is visible to an onlooker.

In accordance with another aspect of the present invention, a method for using the aforementioned attachment apparatus is described. The described method teaches a person to rotate the jaw lever upward, pass the lever through the slot in the covering strap, place the inner and outer jaws on different sides of a top edge of a piece of clothing, and rotate the jaw lever to cause the jaw to bear against the inner jaw thereby gripping the piece of clothing. In an alternate operation, the user slips the slot of the covering strap around a button pre-attached to the top edge of the piece of clothing.

The strap which attaches the jaw mechanism to the suspenders does so in a manner which allows it to be unlooped for removal from the suspenders. Thus, the user may easily change the appearance of the clasping mechanism. The strap serves the dual purpose of covering the mechanical jaws or actually hooking to buttons positioned on the clothing.

Accordingly, it is one feature of the present invention to provide a mechanism for attaching suspenders to articles of clothing whether or not the clothing has specific buttons designated for that purpose.

An additional feature of the present invention is to provide a detachable and replaceable attachment mechanism for suspenders so that an individual may vary the appearance of a pair of suspenders by replacing the attachment mechanism.

The foregoing has outlined rather broadly the features and technical advantages of the present invention in order that the detailed description of the invention that follows may be better understood. Additional features and advantages of the invention will be described hereinafter which form the subject of the claims of the invention.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following DETAILED DESCRIPTION OF THE INVENTION taken in conjunction with the accompanying drawings, in which.

DETAILED DESCRIPTION OF THE INVENTION

Figure 1:
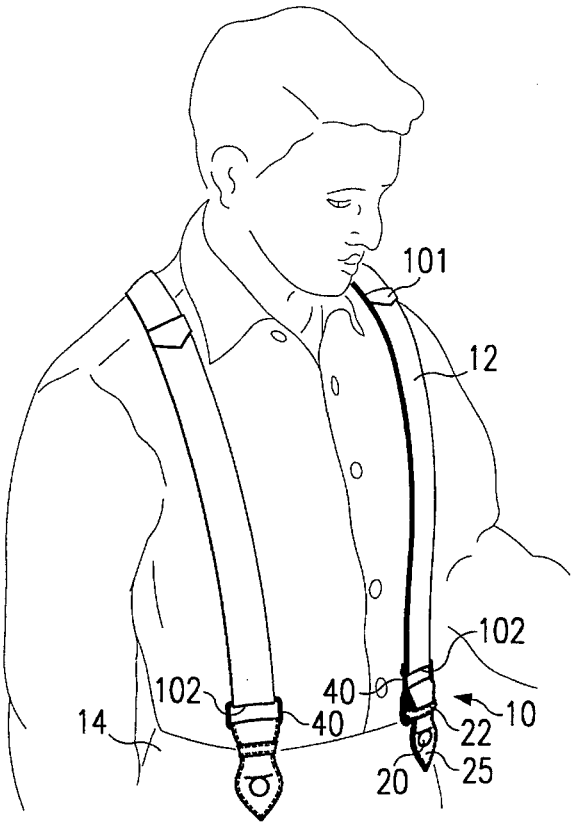
FIG. 1 shows one embodiment of a pair of suspenders/braces and its clip apparatus as applied to a top band of a pair of trousers.

FIG. 1 shows a preferred embodiment of the multi-purpose attachment apparatus 10 securing a pair of suspenders 12 to a pair of pants (or trousers) 14. While the term is used interchangeably, suspenders refer to an apparatus having a clip end and a brace has a button end. In this specification, the term suspender is in reality a suspender/brace combination.

Figure 2A:
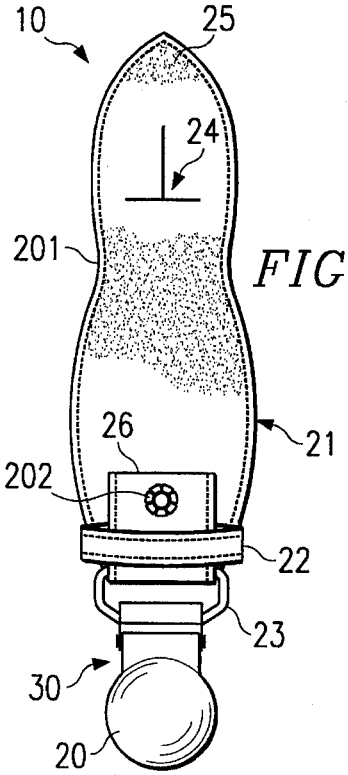
FIG. 2A shows a view of one side of a preferred embodiment of the clip apparatus of the present invention.
Figure 2B:
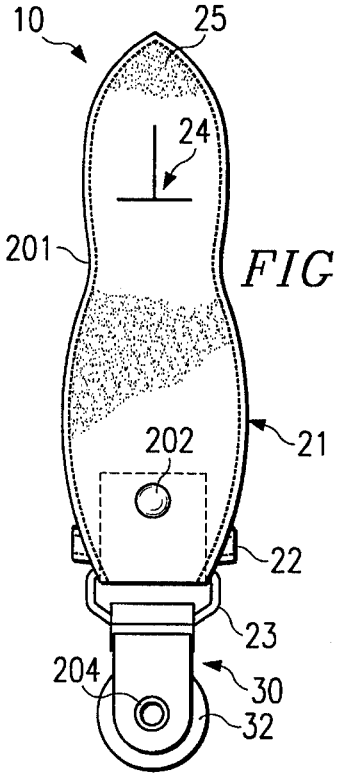
FIG. 2B shows a view of the opposite side (from the side shown in FIG. 2A) of the preferred embodiment of the clip apparatus of the present invention.

FIGS. 2A and 2B show attachment apparatus 10 removed from suspenders 12, unfolded and laid out flat. Attachment apparatus 10 is comprised of gripping section 30 and a connecting loop 21, a flexible strap having ends 25 and 26, and a locking loop 22.

Connecting loop 21 serves to removably connect attachment section 30 to suspenders 12 (shown in FIG. 1) as will be discussed hereinafter.

Loop 21 has narrow end 26 which bends around loop 23 and is pinned to itself by pin 202. Flexible loop 22 is held in place by end 26, either by being pinned by pin 202 or by being held captive within the bottom loop of connecting loop 21. Gripping section 30 is connected to ring 23 in a permanent (or detachable if desired) manner.

Connecting loop 21 has an upside down T-shaped slot 24 fashioned near end 25, the purpose of which will be seen hereinafter.

FIG. 2B shows the reverse side of FIG. 2A and shows teeth 32 (shown in FIG. 3A) attached to backing support 32 by rivet 204. Of course, any attachment, including glue will work. Note that the shape of loop 21 is wider in the middle, and tapering to a narrow section 201 and widening out again at end 25. This will be important as a semi-permanent locking mechanism as will be discussed.

In a preferred embodiment, loop 21 is made of a flexible material such as leather, fabric, plastic, vinyl-coated plastic, or fabric-coated plastic.

Loop 21 may be connected to gripping section 30 in a variety of ways, such as rivets, the well known hook and loop mechanism (VELCRO), etc. Securing means 202 may be a rivet, glue, button, brad, VELCRO® (a well-known hook and loop mechanism), staple or similar means of attachment. A rivet is the preferred securing means, as shown.

Figure 3A:
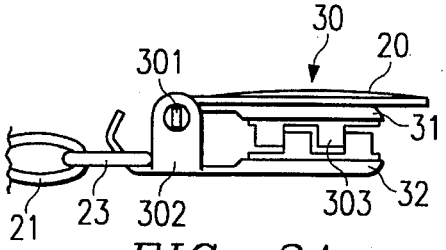
FIGS. 3A & 3B show side views of the gripping mechanism of the clip apparatus of the present invention.
Figure 3B:
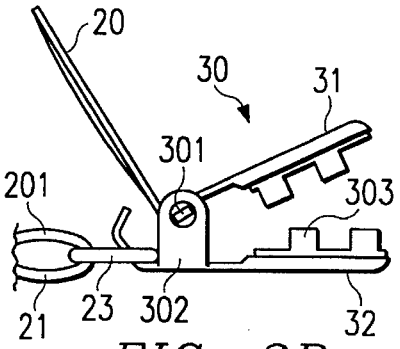

FIGS. 3A and 3B show a preferred embodiment of gripping section 30 comprising an upper jaw 31, a lower jaw 32 and lever 20. Upper jaw 31 and lower jaw 32 are connected to each other and to ring 23 at one end and lever 20 acts as a lever to open and close the jaws. When the jaws are closed, as shown in FIG. 3A, lever 20 lies in the same plans (parallel to the longitudinal axis) and against upper jaw 31.

Lever 20 is pivoted to housing 302 around pin 301 such that it can rotate up and down through a 90 degree angle. Lever 20 is adapted to place pressure on upper jaw 31 such that upper jaw 31 will bear against lower jaw 32 whenever lever 20 is rotated against (or in the same plane as) upper jaw 31. Lever 20 is also adapted to release the pressure on upper jaw 31 whenever the lever is rotated upward and is perpendicular to upper jaw 31 as illustrated in FIG. 3B.

Upper jaw 31 and lower jaw 32 can be placed on different sides of a top edge of a pair of pants or a skirt. The pressure of the two jaws coming together, when lever 20 is moved downward, serves to grip the pants or skirt to secure gripping section 30 to that piece of clothing. Other embodiments of gripping section 30 include a spring-loaded clip and the exact gripping mechanism can include any one of a number of well-known mechanisms.

Gripping section 30 is made of a substantially rigid material such as metal, plastic, stone, bone, ivory, or wood. Gripping section 30 may also be composed of several materials, as for example, metal inlaid with wood or pearl. One of the advantages of the present invention is that one surface of lever 20 is visible on the outside of the article of clothing to which the suspenders are attached, as can be seen in FIG. 2. This visible surface of lever 20 allows an individual to design the lever as a piece of jewelry or as a decorative surface to match one's outfit or other jewelry, such as a pair of cufflinks. Surface 20 can be changed, if desired, by the user.

Figure 4A:
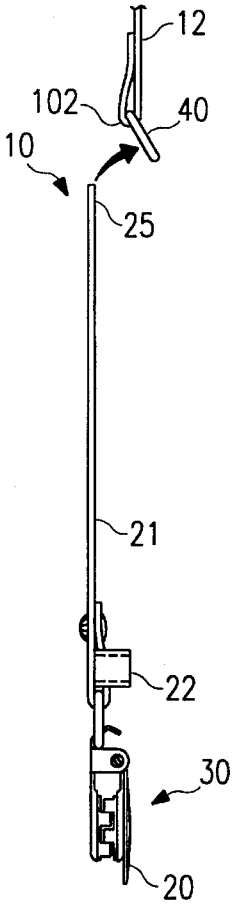
FIGS. 4A through 4D illustrate a method of removably securing the dual purpose attachment apparatus to the end of one loop of a pair of suspenders.
Figure 4B:
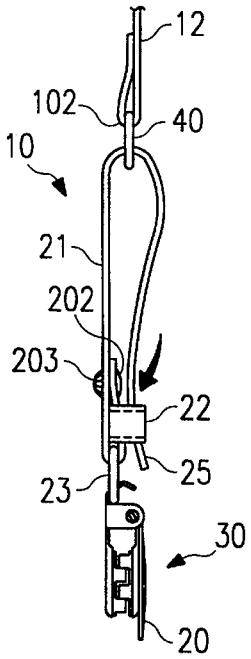
Figure 4C:
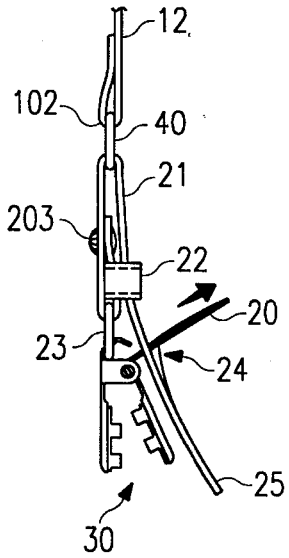
Figure 4D:
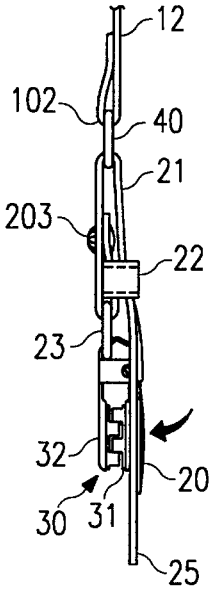

FIGS. 4A through 4D illustrate how attachment apparatus 10 can be secured to a pair of suspenders 12. The top end 25 of loop 21 is placed through a suspender loop 40 attached to an end 102 of a pair of suspenders. End 25 is pulled through suspender loop 40 until suspender loop 40 is located about midway along the length of loop 21 as shown in FIG. 4B. End 25 of loop 21 is then threaded under loop of material 22 which (as discussed above) is secured to loop 21. Once end 25 has been threaded through loop 22, it is pulled through until narrow section 201 (FIG. 2A) is in proximity to loop 22. This serves to lock loop 21 in place. As will be seen, attachment device 10, via slot 24, is now in position to be hooked onto a button affixed to the inside of a pair of pants.

In the event that the user desires to use the jaw mechanism, the mechanism is opened (FIG. 4C), and lever 20 is slipped through slot 24. The top of the pants is placed between the jaws and lever 20 is closed on the outside of loop 21 and on the outside of the pants. End 25 of loop 21 is fashioned to be pleasing to the eye and thus decorative when in combination with the outside (visible) surface of lever 20.

Figure 5:
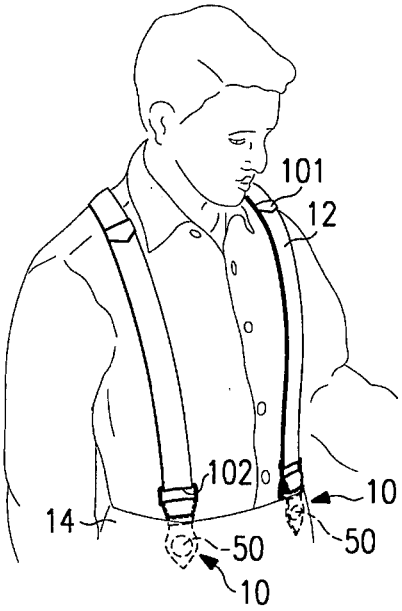
FIG. 5 shows the alternate button hole apparatus of a preferred embodiment of the present invention attached to a button affixed to the inside of a pair of trousers.

In FIG. 5, a user has attached slot 24 to a section inside pants 14. An expanded view of this procedure is shown in FIG. 6B. Note that in this usage the jaw mechanism 30 hangs idle with the jaws closed but not gripping the pants.

Figure 6A:
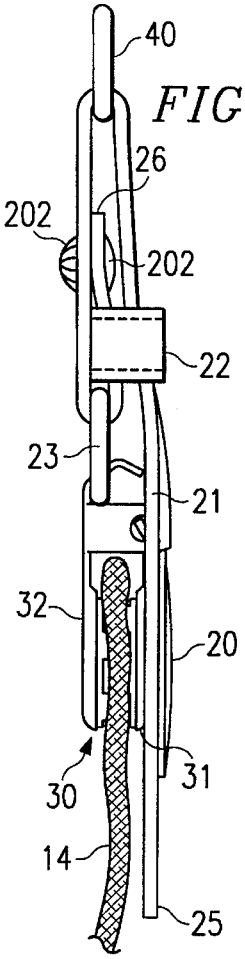
FIG. 6A shows a side view of the attachment of the clip apparatus to a piece of clothing.
Figure 6B:
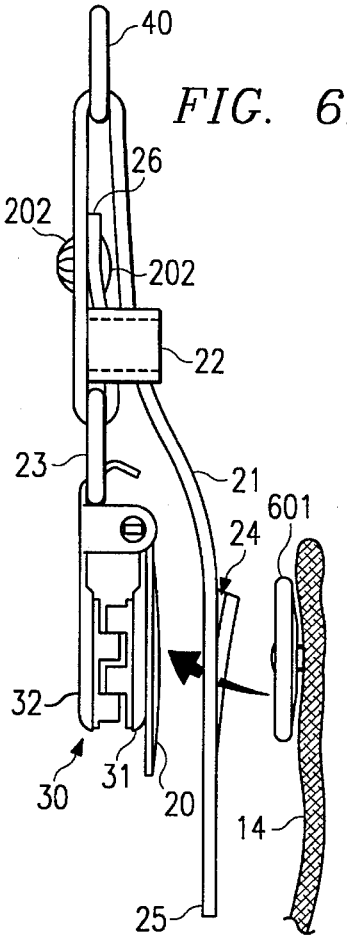
FIG. 6B shows a side view of the attachment of the alternate button hole apparatus to a button affixed to a piece of clothing.

FIG. 6A shows jaw mechanism 30 gripping pants 14 with lever 20 extended to the outside of loop 21 and visible outside pants 14.

As seen in FIG. 6A, the exterior surface area of lever 20 is visible and provides an attractive, decorative surface displayed on top of loop 21. Thus, the exterior surface of lever 20 can be designed to fit an individual's taste in style. The exterior surface may be decorated with gems, a person's initials, or scrimshaw. Since attachment apparatus 10 is detachable from the suspenders, a person can afford to buy an expensive set of attachment mechanisms that can then be used with a variety of suspenders to be worn with any suit or tuxedo. Likewise, one can buy a variety of inexpensive attachment mechanisms to accent one's everyday attire.

Figure 7:
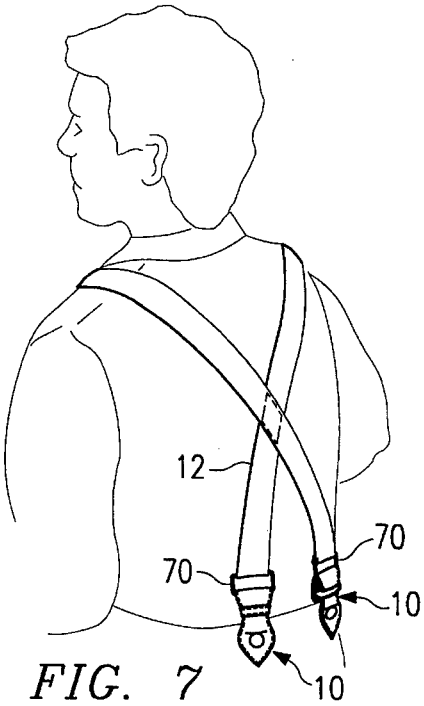
FIG. 7 shows a rear view of the brace/suspender combination.

FIG. 7 shows a rear view of suspenders/braces 12. Each end has loop 70 to which is attached apparatus 10.

Figure 8:
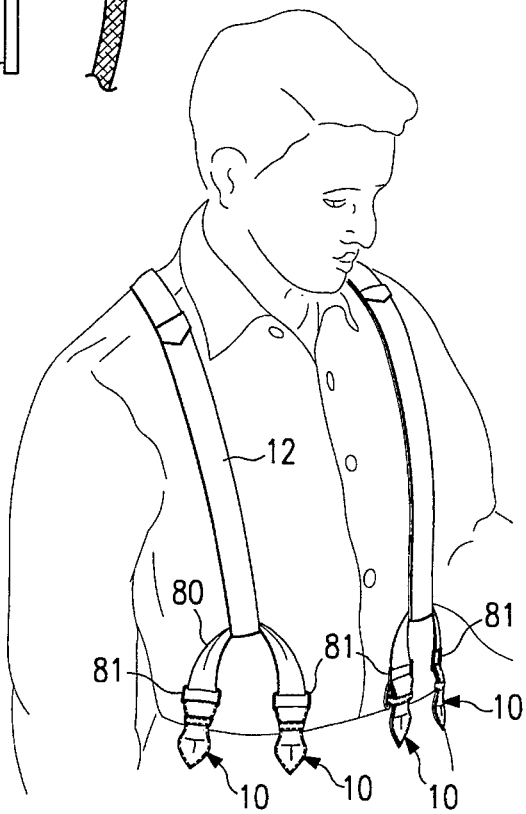
FIG. 8 shows the multi-purpose attachment apparatus used at the ends of a brace.

FIG. 8 shows a typical brace. Yoke 80 is looped through the end of suspender 12 and ends in loop 81 to which apparatus 10 is attached. The user can, as shown in FIG. 6B, use the button hole feature of apparatus 10 to attach to buttons on the clothing or the user can use clip 30 (as shown in FIG. 6A) to snap onto the clothing.

While preferred embodiments of the invention have been shown and described, it will be apparent to those skilled in the art that the conception of the specific embodiments described may be readily utilized as the basis for modifying or designing other attaching apparatuses for carrying out the same purpose as the present invention. It should also be realized by those skilled in the art that such equivalent constructions do not depart from the spirit and scope of the invention as set forth in the appended claims.

Although the present invention and its advantages have been described in detail, it should be understood that various changes, substitutions and alterations can be made herein without departing from the spirit and scope of the invention as defined by the appended claims.

What is claimed is:

1. A pair of suspenders having multiple ends, each end adapted for connection to an article of clothing, at least one of said ends comprising:

a device detachably connected to said one end, said device comprising:

a pair of jaws;

a lever for activating said jaws, said lever being positioned relatively perpendicular to said jaws when said jaws are open and positioned in the same plane of said jaws when said jaws are closed; and a flexible strap interconnecting said device with said suspender end, said strap having one end attached to said device and looped through a ring at said one suspender end and having a free end overlapping said device, said strap having defined in said free end a slot in juxtaposition with said lever when said lever is in said perpendicular position, said slot further adapted for connection with a button affixed to said article of clothing.

2. The apparatus as set forth in claim 1 wherein said strap further includes a ring for interlocking said free end of said strap with said affixed end of said strap.

3. The suspenders as set forth in claim 1 wherein said slot has the shape of a "T" with the top bar of said "T" positioned perpendicular to a longitudinal axis of said strap.

4. The suspenders as set forth in claim 3 wherein said lever is elongated across a longitudinal axis of said jaws and wherein said elongated lever is positioned to pass through said top bar of said "T" slot.

5. The suspenders as set forth in claim 3 wherein said lever is rotatably mounted to said jaws and rotates into a position perpendicular to said jaws when said pressure is released and rotates into a position parallel to the longitudinal axis of said jaws when said mechanical pressure has been applied.

6. A device for detachably connecting to at least one end of a pair of suspenders having multiple ends, said device comprising:

a pair of jaws;

a lever for activating said jaws, said lever being positioned relatively perpendicular to said jaws when said jaws are open and positioned in the same plane of said jaws when said jaws are closed; and a flexible strap for interconnecting said device with said suspender end, said strap having one end attached to said device and looped through a ring at said one suspender end and having a free end overlapping said device, said strap having defined in said free end a slot in juxtaposition with said lever when said lever is in said perpendicular position, said slot further adapted for connection with a button affixed to said article of clothing.

7. A device as set forth in claim 6 wherein said slot has the shape of a "T" with the top bar of said "T" positioned perpendicular to a longitudinal axis of said strap.

8. A device as set forth in claim 7 wherein said lever is elongated across a longitudinal axis of said jaws and wherein said elongated lever is positioned to pass through said top bar of said "T" slot.

9. A device as set forth in claim 7 wherein said lever is rotatably mounted to said jaws and rotates into a position perpendicular to said jaws when said pressure is released and rotates into a position parallel to the longitudinal axis of said jaws when said mechanical pressure has been applied.

10. A pair of suspenders, said suspenders adapted to hold up an article of clothing when attached to said clothing, said suspenders comprising:

a plurality of supporting bands each band having and end thereof forming a loop; and a plurality of mechanisms, each mechanism extending from one of said band loops and each mechanism detachable, said mechanism comprising:

a pair of opposing jaws, said jaws adapted for gripping a top band of said article of clothing;

a lever for opening and loosening said jaws, said lever having an exterior surface area; and an attachment loop laterally spaced apart from said jaws; and a loop of material of sufficient length to detachably connect said attachment loop to said suspender band end loop and to extend in front of said jaws when said jaws are gripping said top band of said article of clothing, said material loop having an opening allowing said lever to pass through said opening; and said opening positioned in said material loop to allow said loop to be removably attached to a button affixed to said top band of said article of clothing.

11. A method of attaching a suspender end to an article of clothing, said method comprising the steps of:

opening a lever to thereby open a pair of opposing jaws;

passing said open lever through a slot formed in a strap connecting said opposing jaws to said suspenders, said strap being affixed to said opposing jaws and extending to said suspender end and looping back from said suspender end to cover said opposing jaws;

placing said opposing jaws on different sides of said clothing; and rotating said lever causing said opposing jaws to bear against said clothing, said rotated lever having an exposed surface on an opposing side of said strap as said opposing jaws.

12. The method of claim 11 further including the steps of:

opening said lever to open said pair of opposing jaws;

retracting said open lever back through said slot;

rotating said lever to cause said opposing jaws to close; and placing said slot around a button affixed to said article of clothing.

* * * * *